United States Patent [19]

Sahlin

[11] 4,149,289

[45] Apr. 17, 1979

[54] METHOD AND MACHINE FOR SPINE BINDING A MEMORIAL BY MEANS OF A THERMOSETTING STRIP

[76] Inventor: Hans O. Sahlin, Langsjovagen 21, S-135 00 Tyresö, Sweden

[21] Appl. No.: 897,486

[22] Filed: Apr. 18, 1978

[30] Foreign Application Priority Data

Apr. 21, 1977 [SE] Sweden ..... 7704562

[51] Int. Cl.[2] ..... B42C 13/00; B42C 19/00

[52] U.S. Cl. ..... 11/1 AD; 156/477 B; 281/21 R; 425/502

[58] Field of Search ..... 11/1 ET, 1 AD, 1 B, 11/2; 425/502; 264/241; 156/583, 477 B; 281/21 R

[56] References Cited

U.S. PATENT DOCUMENTS 3,093,396 6/1963 Segreto ..... 11/1 AD X 3,928,117 12/1975 Sarring ..... 156/477 B 4,009,498 3/1977 Starts et al. ..... 11/1 AD

*Primary Examiner*—Robert L. Spicer, Jr.

*Attorney, Agent, or Firm*—Gipple & Hale

[57] ABSTRACT

A method and machine for adhering a thermosetting strip to the spine and adjacent outside edges of a book formed by the papers and covers comprising a memorial, report etc., whereby the book, clamped in a case is moved rectilinearly to stations for roughing-up its spine, applying a thermosetting band web from a roll carried by a trolley, cutting the web transversely to form the strip, heating and applying pressure to the strip, and cooling it, the trolley with its roll of band being moved in coaction with the case and being subsequently returned to its original position by the case, which then continues to its original position, the necessary movements being motorized and preprogrammed.

3 Claims, 8 Drawing Figures

METHOD AND MACHINE FOR SPINE BINDING A MEMORIAL BY MEANS OF A THERMOSETTING STRIP

The present invention relates to a method for spine binding a memorial consisting of loose sheets, papers etc. and preferably also the wrapper or covers thereto, and a machine for carrying out the method.

With, for example, municipal and other public institutions, office printing establishments and schools there is the need of collecting loose sheets, papers etc. into book form. The spine binding thus required is generally carried out by stapling or glueing the spine and applying a covering strip thereto, this process being lengthy and time-consuming, especially because of the time taken by glueing. It has therefor also been proposed to utilize a tape with a thermoplastic layer which is applied while using heat and pressure, but even here there is the necessary selection of suitable tape width. In both cases a considerable number of tapes having different width are required for using on the memorials, which have varying thickness, changing tapes being also time-consuming, especially if they are to be mounted in a machine.

The present invention has the object of providing a method and a machine whereby it will be possible to quickly and simply bind the memorial by means of a thermosetting strip of tape, independent of the thickness of the memorial. This object is achieved by a method of spine binding a memorial consisting of pages, sheets of paper etc. preferably as well as it covers, said memorial being clamped in a case with its spine along one side of the case, there being a thermosetting strip applied to the spine of the memorial and attached to it under the effect of heat and pressure, whereby the method according to the invention is distinguished in that the spine of the memorial clamped in the case is brought against the end portion of a web, of which the thermosetting strip is a part, said web having a width substantially the same as the length of the memorial spine, and that the cutting means are adjusted in relation to the thickness of the memorial, that the case and web are moved relative to the cutting means which make a cut transverse to the web so that a strip with a somewhat greater width than the width of the spine is cut off, that the projecting flaps of the strip along the lengthwise edges of the spine are folded down towards the edge portions adjacent the spine of the outer sheet or covers, and that the case together with the memorial is moved together with the strip to heating means whereby the thermosetting strip is caused to adhere both to the spinal edges of the sheets and to the edge portions adjacent the spine of the outer pages or covers of the memorial and that the strip is thereafter cooled by the memorial, still in the case, being brought into contact with cooling means so that the strip is fixed against both the whole of the spine and the edge portions of the outside to form a spine binding. The spine of the memorial clamped in the case is preferably brought into contact with a milling cutter or shredder, for roughing-up the spinal surface before the memorial is brought into contact with the strip.

A machine for carrying out the method according to the invention, and comprising a case for carrying the memorial clamped in it, as well as different processing stations for treating the spine of the memorial during the passage of it and the case past these stations, is distinguished according to the invention by straight runners mounted on the machine for carrying the case and guiding it in a straight path along the whole machine; a stationarily mounted first supporting rail at the starting point of the case for supporting one edge portion of the memorial adjacent its spine; a first pressure rail carried by a displaceable slide, said rail being displaceable away from and towards said supporting rail and against the other edge portion of the memorial adjacent its spine; a milling cutter or shredder for machining the spine of the memorial while the spine portion is supported by said support and pressure rails; a support plate with an edge flange, the inside of which is in line with the outside of the first supporting rail and preferably with suction openings; a trolley displaceably carried at the supporting plate for carrying a web from which strips are to be cut; stationarily mounted second, third and fourth support rails in line with the first support rail; second, third and fourth pressure rails carried by slides, and displaceable towards and away from second, third and fourth support rails and also towards the edge portion of the memorial near its spine; a motor-driven cutting means adjacent the outer side of the second pressure rail; chamfering on the third support rail and the third pressure rail ends closest adjacent the second support and pressure rail; heating means adjacent the slide carrying the second and third pressure rail and thereafter cooling means adjacent the slide carrying the fourth pressure rail.

The process will now be described in detail in conjunction with describing an embodiment of the invention shown as an example on the attached drawings where:

FIG. 2 shows the machine in FIG. 1 seen from above.

Figure 3:
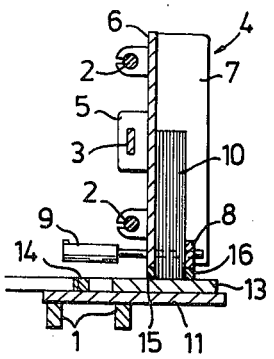
FIG. 3 shows a vertical cross section along the line III—III in FIG. 2.

Carried by a stand denoted by the numeral 1 and only partly shown on the drawings the machine has two horizontal runners 2, extending along the whole machine, but which are partially cut away in FIG. 2, and a rail 3. A case 4 is suspended on the runners 2 and is displaceable along these by means of a linear motor 5 attached to the case and coacting with the rail 3. The case 4 is formed by a vertical plate 6 having side flanges 7 and a clamping plate 8, guided in slots in the flanges 7 and by preferably pneumatically operated clamping means 9 the plate can bear against a memorial 10, consisting of sheets of paper, pages and wrapper or covers lying against the plate 6. The memorial is placed with its spine downwards and, as shown in FIGS. 2 and 3, with the spine resting against a table formed by a horizontal first carrying plate 11, carried by the machine frame 1, there being attached to said plate guide rails 12 with complementary slides 13 mutually united by means of a cross piece 14, which is connected to a compressed-air driven piston-cylinder device 41 for displacing the slides 13. A first support rail 15 is attached to the stationary guide rails 12 directly under the plate 6, and a first pressure rail 16 is attached to the slides 13 directly under the clamping plate 8, FIG. 3. The memorial 10 placed in the case 4 is thus retained by means of the clamping plate 8, and is supported at the outer sides of its spine portion by means of the supporting rail 15 and the pressure rail 16, which have been brought into this position by displacing the slides 13 and thereby the pressure rail.

Figure 1:
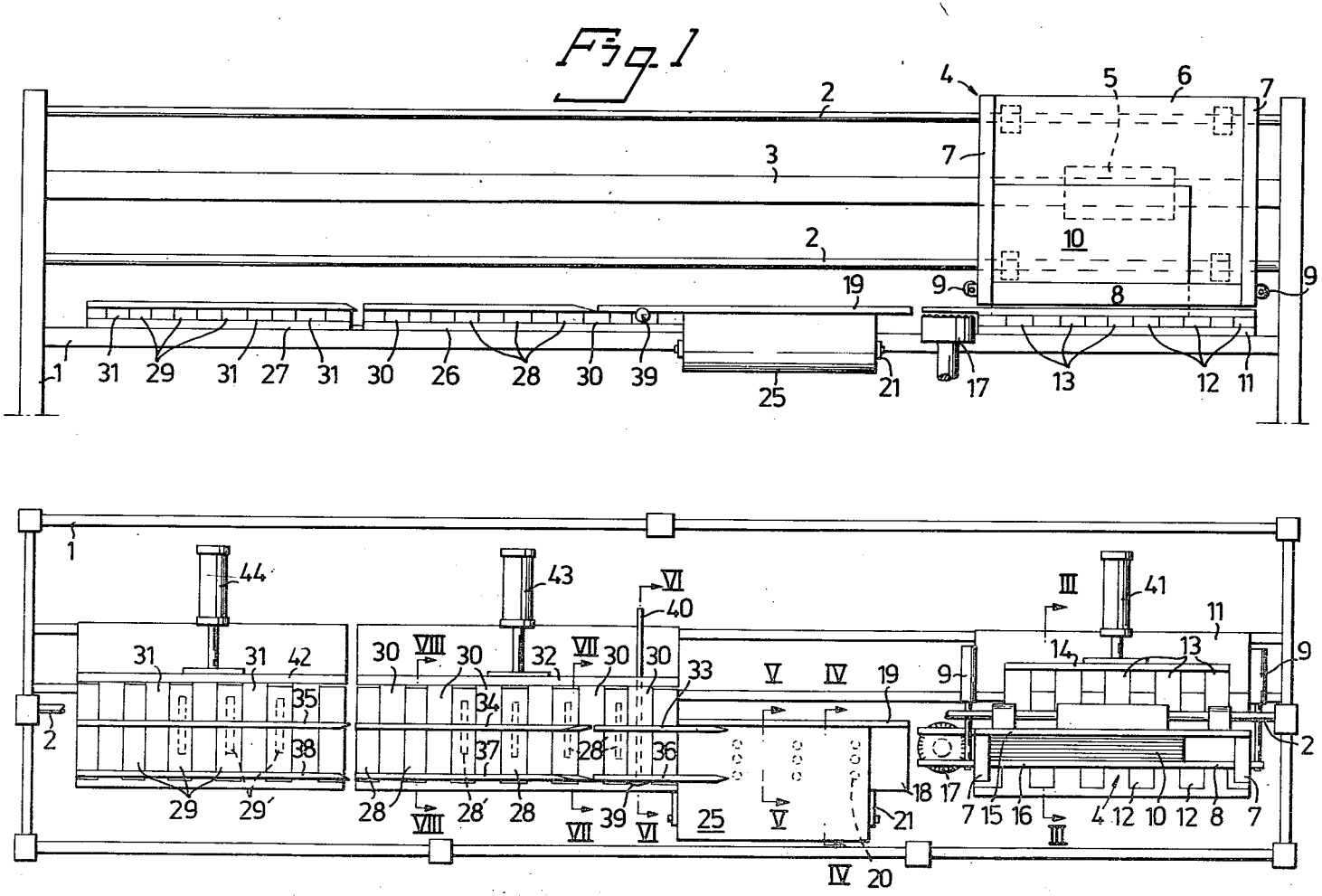
FIG. 1 shows somewhat schematically a side view of the machine according to the invention.

After the carrying plate 11, and consecutively from right to left in FIGS. 1, 2, the machine further comprises: A motor-driven end cutter 17, the cutting edges of which are insignificantly higher than the upper surfaces of the guide rails 12 and slides 13, the rails 15, 16 extending forwards over the cutter, accommodating the cutter by means of recesses on their undersides. (The cutter can suitably assume a somewhat lowered position when it is not in operation.) A horizontal support plate 18 with a flange 19 serving as a guide, and suction openings 20. A trolley 21 schematically shown in FIG. 4, and carried by a shaft 22 extending along the machine and supported against a rail 24 by means of support wheels 23, under loading of a roll 25 of thermosetting band, the thermosetting layer (such as a thermoplastic) of which is on the upper side of the band portion resting on the support plate 18.

The plate 18 is continued by a second carrying plate 26 and a third carrying plate 27, horizontally carried by the stand 1. There are guide rails 28 and 29 attached to the carrying plates 26 and 27, respectively, and against said guide rails there are displaceable slides 30 and 31, respectively, each united with a cross piece 31 and 42, respectively, connected to a piston-cylinder arrangement 43, 44 for compressed air.

A second supporting rail 33 and a third supporting rail 34 are attached to the fixed guiding rails 28, and on the fixed guiding rails 29 there is attached a fourth support rail 35. The support rails 33, 34, 35 and 15 (FIG. 3) are in line, and the flange 19 is immediately outside the outer edge of the rails 15, 33. On one or some of the slides 30 there is a second pressure rail 36, and on remaining slides 30 there is a third pressure rail 37. A fourth pressure rail 38 is attached to the slides 31. The support rail 33 and the pressure rail 36 are attached with a gap between them substantially equal to the thickness of the band) or are sprung against adjacent slides. As is apparent from FIGS. 1, 2, the third support rail 34 and the third pressure rail 37 have inside chamfered ends near the support rail 33 and the pressure rail 36. On the outside of the second pressure rail 36 there is a cutting means, such as a cutting wheel 39, mounted on a shaft 40 extendings through one of the slides 30 to a driving means. At least a portion of the guiding rails 28 contain heating means 28' and at least a portion of the guiding rails 29 contain cooling means 29'.

Figure 4:
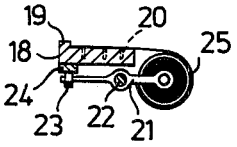
FIG. 4 shows a vertical cross section along the line IV—IV in FIG. 2.
Figure 5:
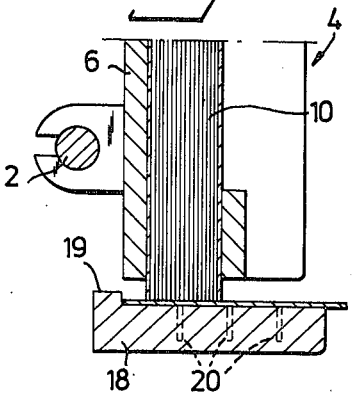
FIGS. 5–8 show to a larger scale vertical cross sections along the lines V—V to VIII—VIII in FIG. 2.
Figure 6:
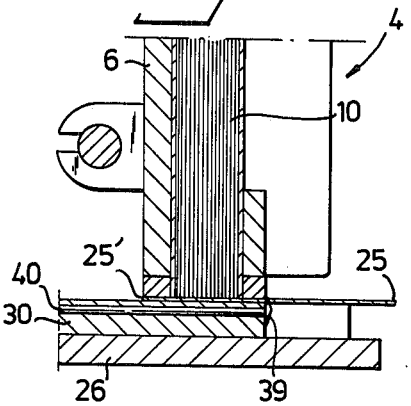
Figure 7:
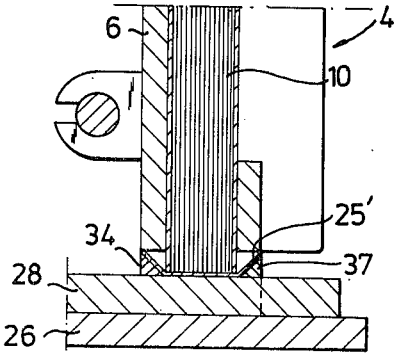
Figure 8:
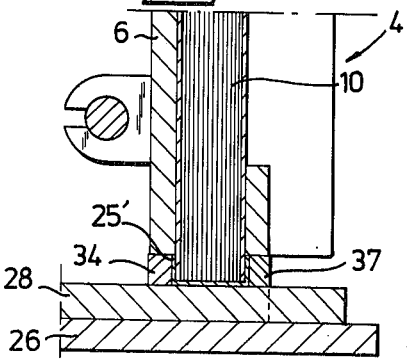

The machine now described functions in the follwoing way. When a memorial is clamped in the case 4, the driving means for the slides 13 is started and the first pressure rail 16 is drawn towards the memorial. Thereafter, the linear motor 5 is started, the case being moved to the left in FIGS. 1 and 2 under the support of the rails 15, 16, and the spine of the memorial passes the cutter 17 so that the sheet or page edges, as well as those of the covers, all forming the spine surface, are roughed-up for forming good adhesion to the strip. It is assumed that in the band trolley 21 there has been mounted a roll of band 25 having the same width as the length of the spine, corresponding for example to the height of an A3- or A4-format, the end portion of the band being sucked against the support plate 18, and the free band edge being supported against the flange 19, as shown in FIGS. 2 and 4. When the case is displaced such that the spine of the memorial is opposite the band web on the support plate 18, the case goes into coupling engagement with the band trolley 21 by means of an unillustrated clutch device, to urge the trolley with it in its displacement. The driving means 43, 44 for the slides 30, 31 have simultaneously operated these so that the pressure rails 36, 37, 38 are adjusted relative to the thickness of the memorial. When the band web, which has passed through the gap under the support rail 33 and pressure rail 36, reaches the cutting wheel 39 in FIG. 6, the wheel makes a cut so that a strip 25' is separated. Already at the beginning of the cut this passes the heating means 30' in the slides 30, whereby the thermosetting layer lying against the spine of the memorial becomes sticky, and the strip 25' accompanies the memorial spine when the case is moved along. As is apparent from FIG. 6, the strip 25' has an outer flap on either side of the spine and when the forward edge of the strip reaches the chamfered ends on the rails 34, 37 these outer flaps are folded and pressed against the covers of the memorial by the support rail 34 and the pressure rail 37 in FIG. 8. At this stage, the strip is heated to a sufficient degree by the heating means for self-curing and for secure attachment to the sheets as well as the covers of the memorial, whereafter the case is moved further for cooling means to come against the strip for adhering it to the memorial, which is possibly stationary for some seconds before the case is returned to the starting position, during which movement the band trolley is returned to its starting position before the case stops at its starting position. The driving devices of the machine are programmed to start and stop in the right order so that only starting needs to be done manually, and possibly drawing the band web against the flange 19, if this is not done by machine.

The most important advantages with the method and machine according to the invention are that the spine of the memorial is roughed-up for increased adhesion to the strip, that a strip is automatically cut off to suit the thickness of the memorial, so that it is not necessary to have a considerable number of tapes with different widths to suit the differing memorial thicknesses. Furthermore, suitably wide flaps are obtained, which are automatically folded against the side edge portions of the memorial adjacent the spine, and heating and cooling takes place while the case with its memorial is moved continuously in an operation cycle taking about 15 seconds, this being the time for the case to move from its starting position until it returns there again. No manual adjustment is required after the memorial has been placed in the case, but possibly some preadjustment of the driving speed of the case, or the heating means, in consideration of the thickness of the memorial and the strip thus required. Band rolls of desired colour can easily be mounted in the band trolley, so that the memorial has the spine colour desired.

The invention is not to be regarded as confined solely to the embodiment described and shown on the drawings, since it can be modified within the purview of the invention. For example, the shredder or cutter, band trolley, rails and slides can be given different embodiments. The whole machine can be orientated in another way, e.g. so that the carrying plates with guide rails and slides are vertical and the case horizontal.

I claim:

1. A method of spine binding a memorial consisting of sheets of paper, pages etc. and preferably the covers thereto, said memorial being clamped in a case with its spine along one side of the case, a thermosetting strip being applied to the memorial spine and being fixed thereto under the action of heat and pressure, characterized in that the spine of the memorial (10) clamped in the case (1) is brought in contact with an end portion of a thermosettable band (25) forming a web, said web having a width substantially equal to the length of the memorial spine; that a cutting means (39) is adjusted to suit the thickness of the memorial; that the case together with the band web is moved relative to the cutting means, which makes a cut transverse to the band web so that a strip (25') having a somewhat greater width than that of the spine is cut off; that the strip thereby cut off has projecting flaps along the edge portions of the spine, said flaps being folded towards the edge portions adjacent the spine of the outside sheets or covers; that the case with the memorial are moved together with the strip against heating means (28'), whereby the thermosetting strip is caused to adhere both to the spine edges of the sheets as well as to the edge portions along the spine of the outside covers; and in that the strip is thereafter cooled by the memorial, still in the case, being brought into contact with cooling means (29'), so that it is attached to the whole spine as well as to the edge portions of the outer sides to form a spine binding.

2. A method as claimed in claim 1, characterized in that the case (1) during the whole of the process is moved in a straight path, and from its starting point is moved so that the spine of the memorial comes into contact with a milling cutter, shredder etc. (17) for roughing-up the spinal surface; that the case, when the memorial spine has come opposite the band in the form of a roll (25) carried by a trolley (21), is temporarily coupled to the trolley; that the case and trolley in this state are moved past the cutting means (39), and that the connection between the case and the trolley is maintained until they have reached the end position of their movement, to be thereafter returned to the starting position of the trolley, where it is disengaged from the case, the latter then being returned with the memorial to their starting position.

3. A machine for carrying out the method according to claim 1 or 2, whereby it comprises a case (1) for carrying a memorial (10) firmly clamped therein, and different operation stations for processing the spine of the memorial during the passage of the case and memorial past said stations, characterized by straight runners (2) mounted on the machine for carrying the case (1) and guiding it in a rectilinear path along the whole machine; a first support rail (15) mounted stationarily at the starting point of the case, for supporting one edge of the memorial (10) adjacent its spine; a first pressure rail (16) carried by a movable slide (13) and displaceable towards and away from said support rail and towards the second edge portion of the memorial adjacent its spine; in sequence from said starting position along the travel of the case there being arranged a milling cutter or shredder (17) for machining the spine of the memorial, while the spinal portion of the memorial is supported by said support and pressure rails (16,16); a support plate (18) with a flange (19), the inside of which is in line with the outside of the first support rail (15) and with the plate preferably provided with suction openings (20); a trolley (21) displaceably mounted at the support plate for carrying a band web (25); second, third and fourth support rails (33, 34, 35) stationarily mounted in line with the first support rail (15); second, third and fourth pressure rails (36, 37, 38) carried by movable slides (30, 31), and displaceable towards and away from the second, third and fourth support rails and the edge portion adjacent the spine of the memorial; a motor-driven cutting means (39) adjacent the outside of the second pressure rail (36); chamfering on the ends of the third support rail (34) and the third pressure rail (37) closest to the support and pressure rails (33 and 36); and by heating means (28') against slides (30) carrying the second and third pressure rails, and thereafter cooling means (29') against slides (31) carrying the fourth pressure rail.

* * * * *